US011376656B2

(12) United States Patent
Gerner et al.

(10) Patent No.: US 11,376,656 B2
(45) Date of Patent: Jul. 5, 2022

(54) CASTING UNIT FOR A DIE CASTING MACHINE

(71) Applicant: Oskar Frech GmbH + Co. KG, Schorndorf (DE)

(72) Inventors: Daniel Gerner, Moegglingen (DE); Juergen Kurz, Pluederhausen (DE); Andreas Sydlo, Urbach (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 0 days.

(21) Appl. No.: 17/337,507

(22) Filed: Jun. 3, 2021

(65) Prior Publication Data

US 2021/0379652 A1 Dec. 9, 2021

(30) Foreign Application Priority Data

Jun. 4, 2020 (DE) ..... 10 2020 207 016.4

(51) Int. Cl.
*B22D 17/32* (2006.01)
*B22D 17/20* (2006.01)
(Continued)

(52) U.S. Cl.
CPC ..... *B22D 17/32* (2013.01); *B22D 17/04* (2013.01); *B22D 17/203* (2013.01); *B22D 17/28* (2013.01); *B22D 39/023* (2013.01)

(58) Field of Classification Search
CPC ..... B22D 17/02; B22D 17/04; B22D 17/20; B22D 17/203; B22D 17/2069;
(Continued)

(56) References Cited

U.S. PATENT DOCUMENTS 4,091,970 A * 5/1978 Komiyama et al. ... B22D 17/04 164/316
5,082,045 A * 1/1992 Lambert ..... B22D 39/00 164/113
(Continued)

FOREIGN PATENT DOCUMENTS

CA 1099476 A 4/1981
CH 542 012 A 9/1973
(Continued)

OTHER PUBLICATIONS

German-language Office Action issued in German Application No. 10 2020 207 016.4 dated Jan. 18, 2021 (six (6) pages).
(Continued)

*Primary Examiner* — Kevin P Kerns
(74) *Attorney, Agent, or Firm* — Crowell & Moring LLP

(57) ABSTRACT

A casting unit for a die casting machine has a casting container with a casting chamber, a casting piston, which is arranged in an axially movable manner in the casting chamber, a melt bath connection opening, a melt inlet channel from the melt bath connection opening to the casting chamber, a melt outlet channel, which leads out of the casting chamber separately from the melt inlet channel, and a shut-off control valve for the melt inlet channel. The shut-off control valve has a valve main body arranged on the casting container, a valve seat and a valve closing body. The valve main body is held on the casting container at a lateral valve assembly region of the casting container in a manner accessible from the outside and includes the melt bath connection opening, and/or the casting piston is of a spool type, and the shut-off control valve is located with its valve closing body in the melt inlet channel at a flow-technical distance from the melt bath connection opening on the one hand and from the casting chamber on the other hand.

19 Claims, 2 Drawing Sheets

(51) Int. Cl.

| | |
|---|---|
| ***B22D 17/28*** | (2006.01) |
| ***B22D 17/04*** | (2006.01) |
| ***B22D 39/02*** | (2006.01) |

(58) Field of Classification Search

CPC ..... B22D 17/28; B22D 17/32; B22D 39/02; B22D 17/30; B22D 39/023

USPC ..... 164/312, 316, 113, 120

See application file for complete search history.

(56) References Cited

U.S. PATENT DOCUMENTS

| | | | |
|---|---|---|---|
| 5,385,456 | A | 1/1995 | Mancini |
| 6,761,209 | B2 | 7/2004 | Fink |
| 9,233,417 | B2 | 1/2016 | Erhard et al. |
| 9,505,053 | B2 | 11/2016 | Aspacher et al. |
| 2003/0029596 | A1 | 2/2003 | Fink |
| 2012/0273530 | A1 | 11/2012 | Erhard et al. |
| 2014/0042193 | A1 | 2/2014 | Aspacher et al. |

FOREIGN PATENT DOCUMENTS

| | | | |
|---|---|---|---|
| DE | 32 48 423 | A1 | 6/1984 |
| EP | 0 576 406 | B1 | 9/1997 |
| EP | 1 407 843 | A1 | 4/2004 |
| EP | 1 284168 | B1 | 12/2005 |
| EP | 2 506 999 | B1 | 1/2017 |
| EP | 2 701 866 | B1 | 11/2018 |
| WO | WO 91/17010 | A1 | 11/1991 |

OTHER PUBLICATIONS

German-language European Search Report issued in European Application No. 21175326.4.4 dated Oct. 4, 2021 with partial English translation (nine (9) pages).

* cited by examiner

CASTING UNIT FOR A DIE CASTING MACHINE

CROSS REFERENCE TO RELATED APPLICATION

This application claims priority under 35 U.S.C. § 119 from German Patent Application No. 102020207016.4, filed Jun. 4, 2020, the entire disclosure of which is herein expressly incorporated by reference.

BACKGROUND AND SUMMARY OF THE INVENTION

The invention relates to a casting unit for a die casting machine, the casting unit comprising a casting container with a casting chamber, a casting piston, which is arranged in an axially movable manner in the casting chamber, a melt bath connection opening, a melt inlet channel from the melt bath connection opening to the casting chamber, a melt outlet channel, which leads out of the casting chamber separately from the melt inlet channel, and a shut-off control valve for the melt inlet channel. According to its designation, the shut-off control valve constitutes a controllable shut-off valve and comprises a valve main body, which is arranged on the casting container and has a valve seat and a valve closing body which can be moved relative to the valve seat between an open position and a closed position.

Such casting units of generic type and similar casting units are used for providing melt material to be cast, in order in this way to cast a specific component, also referred to as cast part, in a respective casting operation or casting cycle. The present casting unit is suitable in particular for metal die casting, for example for casting liquid or partially liquid metal melts, such as zinc, lead, aluminium, magnesium, titanium, steel, copper and alloys of these metals, and in this respect preferably for a hot-chamber die casting machine. In this appliance, the casting container is located dipped in a melt bath, which is kept ready by a melt container. As an alternative, the die casting machine may be a cold-chamber die casting machine or a plastics injection moulding machine, for example.

The melt material is introduced into the casting unit from a melt bath, for example, via the melt bath connection opening and passes into the casting chamber via the melt inlet channel. This is brought about in a melt feeding operation or melt drawing-in operation typically by means of negative pressure in the casting chamber owing to a return movement of the casting piston. In a mould filling phase of the casting operation, a forwards movement of the casting piston presses melt material located in the casting chamber under pressure out of the casting chamber and the casting container into a mould cavity, also referred to as mould hollow space or mould in short, via the melt outlet channel, in order to form a corresponding cast part. In typical implementations, after it leaves the casting chamber, the melt material exits the casting container via a riser pipe region, for example, and arrives at a melt inlet in the region of the mould cavity, which is usually formed by a fixed mould half and a movable mould half, via a mouth nozzle body joined to the casting container.

Two fundamentally different types of casting piston can be used for the casting piston: casting pistons of the spool type and casting pistons of the displacement type. In the case of the spool type, the outer dimension of the casting piston corresponds to the inner dimension of the casting chamber, the piston being sealed with respect to the casting chamber wall. Consequently, in this case, when it moves forward, the casting piston fully pushes the melt material in the casting chamber forwards and in the process exerts the necessary pressure on the melt material to press it into the mould cavity. In the case of the displacement type, the outer dimension of the casting piston is suitably smaller than the inner dimension of the casting chamber such that, when it moves forwards, the casting piston dips into the melt material of the casting chamber. The action of pressure on the melt material is brought about in this case by the displacement effect of the casting piston volume which dips into the melt material. Casting units with a casting piston of the spool type are disclosed in laid-open publication WO 91/17010 A1 as well as in patent publications EP 1 284 168 B1 and EP 2 701 866 B1, for example. Casting units with a casting piston of the displacement type are disclosed in laid-open publication DE 32 48 423 A1 as well as in patent publications EP 0 576 406 B1 and EP 2 506 999 B1, for example.

In the case of the casting unit of the generic type, the melt outlet channel leads out of the casting chamber separately from the melt inlet channel, i.e. the melt inlet channel and the melt outlet channel form two separate guide channels for the melt material with a casting chamber inlet, at which the melt inlet channel opens out into the casting chamber, and a separate casting chamber outlet, at which the melt outlet channel opens out from the casting chamber. As an alternative, other types of casting unit may also be used.

So, in the case of the casting unit according to WO 91/17010 A1 mentioned, the melt inlet channel and the melt outlet channel share a common channel portion, which is connected to a single connection opening of the casting chamber that functions as inlet and outlet. In order to control the direction of the melt flow, arranged at suitable locations are two fluid control valves, i.e. controllable fluid valves: a switchover control valve and a shut-off control valve.

In the case of a casting unit disclosed in patent publication CA 1099476, arranged at an outlet of the casting chamber is a switchover valve, which in a first position connects the casting chamber outlet to the melt bath and shuts off a riser channel portion and in a second position enables the connection of the casting chamber outlet to the riser channel portion and shuts off the casting chamber with respect to the melt bath.

In the case of the casting unit disclosed in EP 2 701 866 B1 mentioned, the melt feed into the casting chamber is effected by an annular space between the casting chamber and a piston skirt of the casting piston, which is designed as a spool, and by a channel portion which is guided through the casting piston and can be shut off by a shut-off control valve designed as a check valve and integrated in the casting piston.

The casting unit disclosed in EP 0 576 406 B1 mentioned is of the generic type, where in this casting unit the melt inlet channel is formed by a melt feed bore which passes through a wall of the cylindrical casting chamber and the shut-off control valve is arranged with its valve closing body directly at the opening of the melt feed bore into the casting chamber.

The casting unit disclosed in DE 32 48 423 A1 mentioned is likewise of the generic type, where in this casting unit the valve main body is designed as fully ceramic and is inserted in an accurately fitting manner in a vertical receiving bore, which is formed therein from a top side of the casting container. In an adjacent side region, formed in the casting container is a horizontal inlet bore, which forms the melt bath connection opening of the casting unit on the inlet side and is in line with an inlet bore of the valve main body on the outlet side.

In die casting, for economic reasons it is sought for a cycle time, i.e. duration of a respective casting operation, to be as short as possible, and for reasons relating to the quality of the cast part it is sought for the amount of air in the cast part to be as low as possible, i.e. for a minimum air porosity of the cast part. For various reasons, in this respect the speed of the forwards movement of the casting piston in the mould filling phase cannot exceed a certain rate. In order to account for these aspects, EP 1 284 168 B1 mentioned proposes, at the beginning of the mould filling phase and/or before the actual mould filling phase, to move the casting piston forward already when the mould is still open in a pre-filling phase far enough that the melt material fills the riser channel region and the mouth nozzle body region, before the mould is then closed and the casting piston is further moved forwards for carrying out the actual mould filling phase. In said document, the casting piston is of the spool type and itself functions as a shut-off member, in that during the refilling phase it opens up the casting chamber inlet by virtue of a return movement thereof behind it, and during the mould filling phase shuts off said casting chamber inlet by being moved forward beyond it.

The invention is based on the technical problem of providing a casting unit of the type mentioned at the outset, which provides advantages over the prior art cited above, in particular in terms of relatively low production and assembly outlay and/or relatively low maintenance/repair outlay and/or in terms of a reliable function during the casting operation.

The invention solves said problem through the provision of a casting unit comprising a casting container with a casting chamber, a casting piston, which is arranged in an axially movably manner in the casting chamber, a melt bath connection opening, a melt inlet channel from the melt bath connection opening to the casting chamber, a melt outlet channel, which leads out of the casting chamber separately from the melt inlet channel, and a shut-off control valve for the melt inlet channel, the shut-off control valve comprising a valve main body, which is arranged on the casting container and has a valve seat, and a valve closing body which can be moved relative to the valve seat between an open position and a closed position.

The casting unit according to the invention comprises the shut-off control valve for the melt inlet channel, as a result of which the melt flow in the melt inlet channel can be controlled independently by corresponding control of the shut-off control valve, without it being necessary for the casting piston to act as a shut-off member for this purpose, for example. This active control option, performed manually by the user or automatically by an assigned control unit, for example, distinguishes the shut-off control valve from a mere check valve, for example, which assumes its open position or its closed position in an uncontrolled manner only on account of the respectively prevailing melt pressure conditions, and accordingly enables a targeted, active influence of the melt throughflow rate in the melt inlet channel.

According to one aspect of the invention, the valve main body of the shut-off valve is held on the casting container at a lateral valve assembly region of the casting container in a manner accessible from the outside and comprises the melt bath connection opening. In this respect, the designation of a lateral valve assembly region and/or lateral casting container region is understood to mean a side region of the casting container which is located on a side of the casting container in the operating position of the casting unit on the die casting machine, i.e. on a side of the casting container which runs between a side at the top in this operating position, i.e. a top side, and a side at the bottom in this operating position, i.e. a bottom side, of the casting container.

This constitutes an implementation and positioning of the shut-off control valve and/or of its valve main body that are operationally favourable and optimized in terms of production and assembly outlay and also maintenance/repair outlay. The shut-off control valve can be assembled on the casting container laterally from the outside, and the assembled shut-off control valve is accessible for maintenance work laterally from the outside of the casting container. For the maintenance of the shut-off control valve, it is therefore normally not necessary to disassemble the casting container. Furthermore, when the system is correspondingly designed, there is the option of being able to disassemble the shut-off control valve from the casting container relatively easily in a manner accessible from the outside, for example in order to exchange a wear-afflicted component of the valve if necessary during repair work.

According to a further aspect of the invention, which may be provided in addition or as an alternative to the aspect mentioned above, the casting piston is of the spool type, and the shut-off control valve is located with its valve closing body in the melt inlet channel at a flow-technical distance from the melt bath connection opening on the one hand and from the casting chamber on the other hand, i.e. the shut-off control valve is located neither directly at the melt bath connection opening nor directly at the casting chamber, but rather between these two end points at a location of the melt inlet channel that is spaced apart from these two end points. It is found that this combination of spool and specific positioning of the shut-off control valve can have an unexpectedly positive effect on the reliable function of the casting unit and the associated die casting machine during operation, in particular in terms of operational control, in the case of which it is ensured that, after the respective casting operation, the melt material is drawn back only as far as the front region of the mouth nozzle body and/or that, before the respective mould filling phase, when the mould is still open, the melt material is moved forwards into the front mouth nozzle body region.

Advantageous refinements of the invention are specified in the dependent claims.

In a refinement of the invention, the main body of the shut-off control valve is held on the casting container by a detachable connection. This makes it advantageously possible to remove the valve main body from the casting container as required in a simple manner, e.g. for repair purposes, including the possibility of exchanging components of the valve in the course of repair or maintenance work. In alternative embodiments, the valve main body is held on the casting container non-detachably, i.e. cannot be detached without damage. This may be sufficient e.g. for usage situations in which exchanging the shut-off control valve and/or its valve main body or other components of the valve during the operating period of the casting container does not appear to be necessary.

In a refinement of the invention, the valve assembly region of the casting container is formed by a valve receiving space with a laterally outwardly facing access side, and the valve main body of the shut-off control valve can be inserted into the valve receiving space laterally from the outside via the access side. The positioning, facing outwardly on the side of the casting container, of the access side has proven to be advantageous for assembly-related and functional reasons. In this way, this measure can facilitate access to the valve main body and thus to the shut-off control valve as a whole via the outwardly facing access side of the casting container. This correspondingly facilitates the assembly of the shut-off control valve on the casting container and any disassembly of the valve or of components thereof from the casting container.

The access side may be in the form of an outwardly open side of the valve receiving space or as a side which is covered by a detachable covering. In the latter case, it is necessary merely to remove the covering from the casting container to allow access to the shut-off control valve located in the valve receiving space. In alternative embodiments, the valve assembly region of the casting container is formed, e.g., by a valve receiving space with an upper or lower outwardly facing access side, or it is formed by a side surface of the casting container on which the shut-off control valve can be assembled with its valve main body without the casting container having an associated valve receiving space.

In a configuration of the invention, the valve main body is inserted with its downwardly pointing valve outlet into the valve receiving space, and the melt inlet channel continues from the valve outlet with a channel portion in the casting container which leads downwardly out of the valve receiving space. This measure is advantageous in terms of the guidance of the melt material in the melt inlet channel and the assembly position of the main body of the shut-off valve. In this respect, what is meant by the directional indication "downwardly" or "downwards" is a direction which extends in the operating position of the casting unit on the die casting machine with a vertically downwardly pointing main direction component, i.e. parallel to the vertical downwards or with a vertical direction component which is larger than the horizontal direction component obliquely downwards.

In this way, in this case the shut-off valve can be placed with its valve main body on a valve support surface, into which this continuing channel portion opens out, as a result of which it is fluidically connected to the valve outlet. In alternative embodiments, the outlet of the shut-off control valve is located not on the underside but e.g. on a lateral region of the valve main body, and the melt inlet channel continues in the casting container e.g. with an initially substantially horizontal channel portion.

In a further configuration of the invention, the valve main body is held in a clamped-in manner in the vertical direction in the valve receiving space by a detachable clamping connection and on the underside bears against a seal which seals the valve outlet. This constitutes a feature which is largely advantageous in terms of assembly and function. The detachable clamping connection makes it possible for the shut-off control valve to be held with its valve main body reliably on the casting container and to be detached therefrom as required. The seal makes it possible for the valve outlet to be sealed with respect to the environment in a desired manner, the sealing action additionally being assisted in that the clamping connection presses the valve main body against the seal. As an alternative, the valve main body may be held on the casting container in another way, e.g. by a corresponding screw connection.

In a refinement of the invention, the shut-off control valve has a control rod, which is guided in a translatory-movable manner on the valve main body, at one end bears the valve closing body and with its other end extends out of the valve main body, and extends out of the casting container through a rod passage opening in the casting container. This constitutes an implementation of the shut-off control functionality of the shut-off control valve that is favourable from a manufacturing technology and functional perspective. As an alternative, this shut-off control functionality may be implemented in another, conventional way, e.g. as a solenoid control valve with a magnetically actuated valve closing body.

In a configuration of the invention, the control rod is arranged with its rod longitudinal axis parallel to a longitudinal axis of the casting piston. This constitutes an advantageous arrangement of the control rod in terms of a compact design of the casting unit and in terms of the control actuation of the shut-off control valve. As an alternative, the control rod may be arranged with its rod longitudinal axis obliquely or perpendicularly in relation to the longitudinal axis of the casting piston.

In a configuration of the invention, the casting unit includes a lateral control rod insertion slot in the casting container for lateral insertion of the control rod into the valve receiving space of the casting container and for lateral removal from the same. This measure offers advantages in terms of simple assembly and disassembly of the shut-off control valve, including the control rod and the valve closing body which it bears, on or from the casting container.

In this way, it is thus possible, for example, to facilitate the assembly and disassembly of the shut-off control valve on or from the casting container in that the control rod together with the valve closing body can remain on or in the valve main body during the disassembly of the valve main body from the casting container, as a result of which it is not necessary to be able to disassemble the control rod and the valve closing body when the valve main body is still assembled on the casting container in order to then be able to remove the valve main body from the casting container. Rather, to disassemble the valve main body from the casting container, it is possible in this case for the control rod together with the valve closing body to remain on or in the valve main body and, via the control rod insertion slot in the casting container, to be introduced therein for assembling the valve and/or moved out along it for disassembling the valve. In alternative embodiments, this lateral control rod insertion slot in the casting container is dispensed with and instead the control rod is inserted axially into the rod passage opening in the casting container or moved out thereof.

This may optionally be combined with the measure in which the control rod insertion slot extends and opens from the control rod passage opening in the direction of the lateral access side of the valve receiving space, or in which the valve receiving space has, in the longitudinal direction of the control rod insertion slot, a further access side via which the valve main body can be inserted laterally from the outside into the valve receiving space of the casting container.

In a refinement of the invention, the melt inlet channel contains at least one transverse bore in the valve main body that forms the melt bath connection opening on the inlet side and opens out into a longitudinal bore, through which the control rod extends and which forms the valve seat on the outlet side, in the valve main body on the outlet side. This constitutes an implementation for the shut-off control valve that is favourable in terms of the guidance of the melt and the manufacturing outlay.

The melt material stored in a melt container may in this case enter the valve via the one or more transverse bores, which in the operating position of the casting unit run e.g. horizontally or obliquely with a horizontal main direction component, and may there be guided into the casting container via the longitudinal bore under the control of the control rod with the valve closing body coupled thereto, in order to feed it to the casting chamber in a controlled manner. As an alternative, the valve main body may have e.g. an upper or lower inlet bore for the melt material.

Advantageous embodiments of the invention are illustrated in the drawings. These and further embodiments of the invention will be described in more detail below.

DETAILED DESCRIPTION OF THE DRAWINGS

Figure 1:
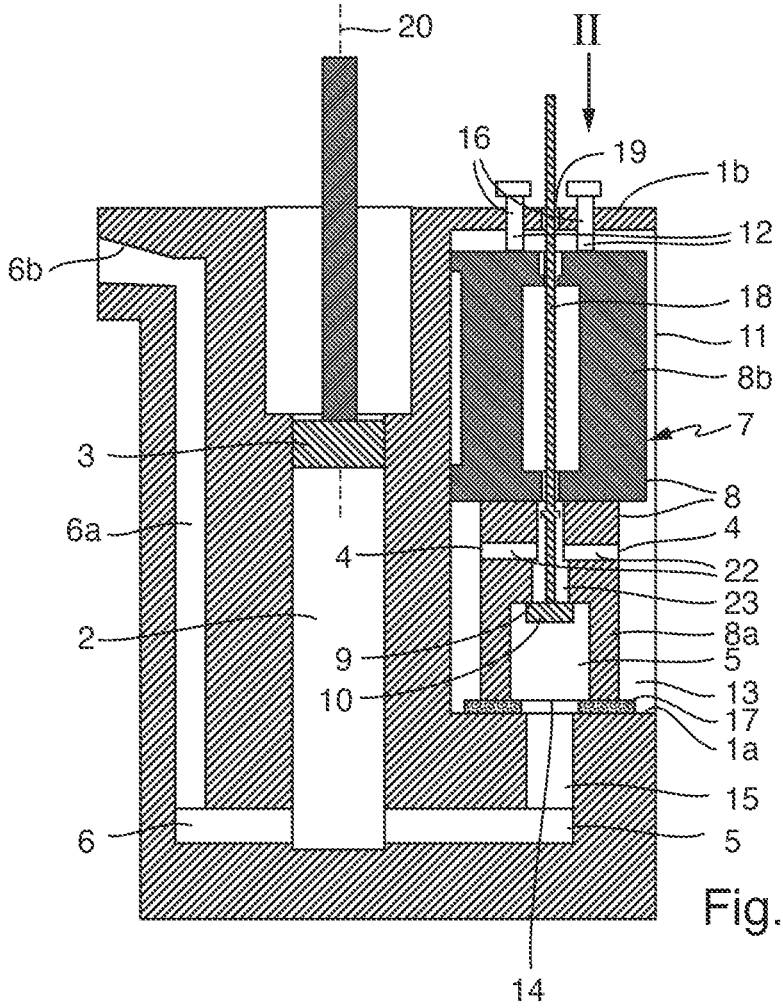
FIG. 1 shows a schematic longitudinal sectional view of a casting unit with a shut-off control valve in the closed position held on the casting container.

The casting unit shown is suitable for use in a die casting machine, in particular a die casting machine of the hot-chamber type for metal die casting, it being possible for the metal casting material to be e.g. zinc, lead, aluminium, magnesium, titanium, steel, copper or alloys of these metals. The casting unit contains a casting container 1 with a casting chamber 2 and contains a casting piston 3, which is arranged in an axially movable manner in the casting chamber 2, a melt bath connection opening 4, a melt inlet channel 5 from the melt bath connection opening 4 to the casting chamber 2, a melt outlet channel 6, which leads out of the casting chamber 2 separately from the melt inlet channel 5, and a shut-off control valve 7 for the melt inlet channel 5. The shut-off control valve 7 has a valve main body 8 which is arranged on the casting container 1 and has a valve seat 9 and a valve closing body 10 which can be moved relative to the valve seat 9 between an open position and a closed position.

In the exemplary embodiment shown, the valve closing body 10 has the form of a circular disc, and, corresponding to this, the valve seat 9 is formed on the valve main body 8 with a planar seat surface. In alternative embodiments, the valve closing body 10 may have another form, e.g. a frustoconical form, the valve seat 9 having a matching seat form such that the valve closing body 10 bears in a fluid-tight manner against the valve seat 9 in its closed position.

By using the shut-off control valve 7 it is not necessary to use the casting piston 3 as a shut-off member for the melt inlet channel 5. Expressed differently, the melt inlet channel 5 does not need to open out into the casting chamber 2 at a location that can be blocked by the casting piston 3. Since the melt outlet channel 6 leads out of the casting chamber 2 separately from the melt inlet channel 5, it has an opening out of the casting chamber 2 that is separate from the opening of the melt inlet channel 5 into the casting chamber 2.

In advantageous embodiments, the valve main body 8, as in the example shown, is held on the casting container at a lateral valve assembly region 11 of the casting container 1 in a manner accessible from the outside and comprises the melt bath connection opening 4. This measure makes it possible to assemble the shut-off control valve 7 with its valve main body 8 on the casting container 1 laterally from the outside. In addition, the shut-off control valve 7 assembled there remains accessible from the outside for maintenance work, without it being absolutely necessary to disassemble it from the casting container 1 for this purpose.

In advantageous embodiments, the casting piston 3 is of the spool type, as in the example shown, and the shut-off control valve 7 is located with its valve closing body 10 in the melt inlet channel 5 at a flow-technical distance behind, i.e. downstream of, the melt bath connection opening 4 on the one hand and in front, i.e. upstream, of the casting chamber 2 on the other hand. Expressed differently, the valve closing body 10 is located neither directly at the melt bath connection opening 4, which forms an inlet opening of the shut-off control valve 7 for melt material from a melt bath, nor directly at the opening of the melt inlet channel 5 into the casting chamber 2, but rather between these end points of the melt inlet channel 5 at a suitable location along the melt inlet channel 5.

In the exemplary embodiment shown, the valve main body 8 comprises a base body 8*a* and a guide body 8*b* in the form of separately manufactured components. In alternative embodiments, the valve main body 8 is produced in single-part form or is assembled from more than two components. In the example shown, the valve seat 9 is formed on the base body 8*a*. It is similarly the case in this example that the melt bath connection opening 4 is located on the base body 8*a*.

In advantageous embodiments, the valve main body 8 of the shut-off control valve 7, as in the example shown, is held on the casting container by a detachable connection 12. This allows the valve main body 8, and thus the shut-off control valve 7 as a whole, to be disassembled from the casting container 1 without problems, e.g. for the purpose of repairing or exchanging a valve component owing to wear or another loss of functionality. In the example shown, the detachable connection 12 is implemented by a screw connection; in alternative embodiments it may be implemented in a different way, e.g. by a detachable latching or snap-fit connection.

In advantageous embodiments, the valve assembly region 11 of the casting container 1, as in the example shown, is formed by a valve receiving space 13 with a laterally outwardly facing access side, and the valve main body 8 of the shut-off control valve 7 is inserted into the valve receiving space 13 laterally from the outside by way of the access side. In the example shown, this access side is formed by a rearwards-facing side of the casting container 1 in FIG. 1 and by an upwardly facing side of said casting container in FIG. 2.

In corresponding embodiments, as in the example shown, the valve receiving space 13 is formed with at least one further laterally outwardly facing access side, as e.g. a right side of the casting container 1 in FIG. 1. More specifically, in the exemplary embodiment shown, the valve receiving space 13 is formed by a lateral recess in the casting container 1 with a base surface 1*a* as a lower boundary of the valve receiving space 13 and an upper retaining flange 1*b* of the casting container 1 as an upper termination of the valve receiving space 13, the valve receiving space 13 in this example being accessible from three sides and/or being open to three sides. The shut-off control valve 7 may in this case be placed with its valve main body 8 onto the base surface 1*a*, which in that case functions as a valve support surface.

The access side may be used as required not only for assembling, but also for disassembling the valve main body 8 or the shut-off control valve 7 from the casting container 1. In the exemplary embodiment shown, the access side is open; in alternative embodiments, it may be covered by a detachable covering.

Figure 3:
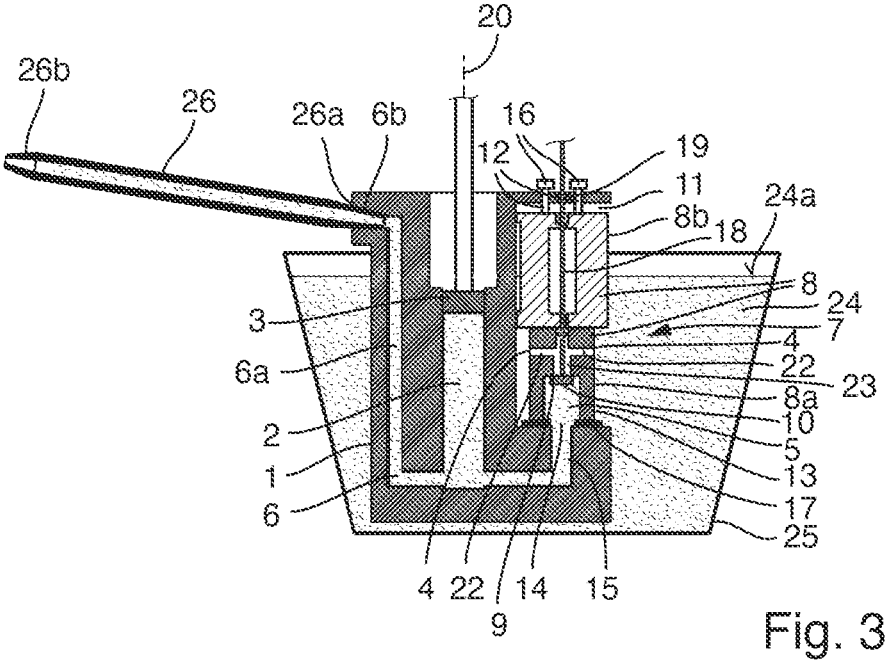
FIG. 3 shows the view of FIG. 1 with the casting container in an operating position in which it is dipped in a melt bath and with an attached mouth nozzle body.
Figure 4:
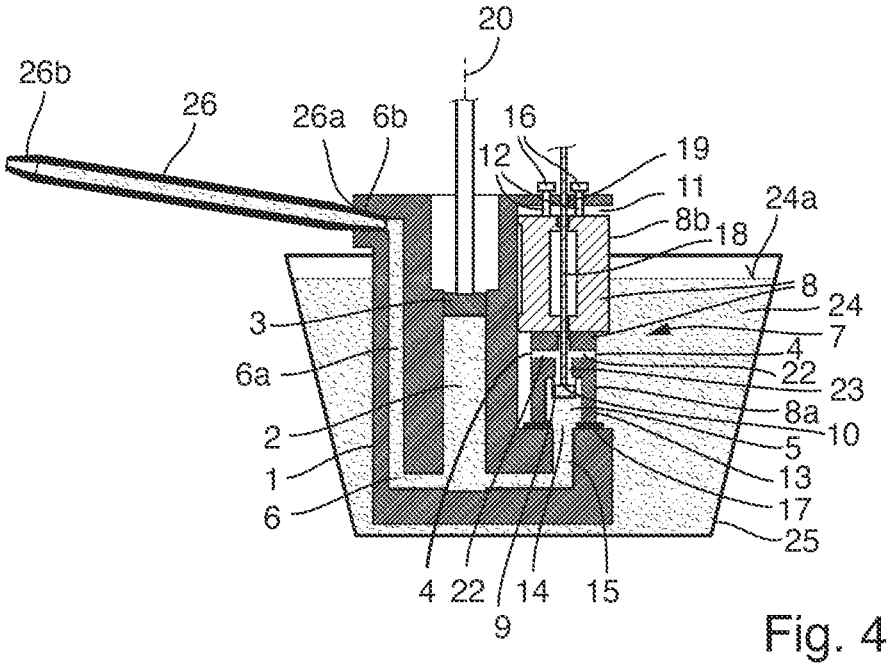
FIG. 4 shows the view of FIG. 3 in an open position of the shut-off control valve.

In advantageous embodiments, as in the example shown, the valve main body 8 is inserted with its downwardly pointing valve outlet 14 into the valve receiving space 13, and the melt inlet channel 5 continues from the valve outlet 14 to the casting container 1 with a channel portion 15 which leads downwardly out of the valve receiving space 13. In the case of the directional indication "downwardly" or "downwards", a position of the casting container 1 is presumed which it has on the die casting machine during operation, where FIGS. 1, 3 and 4 show the casting container 1 in this operating position.

In advantageous embodiments, the valve main body 8 is held in a clamped-in manner in the vertical direction in the valve receiving space 13, as in the example shown, by a detachable clamping connection 16 and on the underside bears against a seal 17 which seals the valve outlet 14. Specifically, in the example shown, the base body 8*a* and the guide body 8*b* of the valve main body 8 are arranged one on top of the other, and the valve outlet 14 is located on the underside of the base body 8*a*, while the clamping device 16 presses the guide body 8*b* from above against the base body 8*a*, which in turn presses with its underside surface against the seal 17, which bears against the base surface 1*a* of the valve receiving space 13 and surrounds in an annularly closed manner the valve outlet 14 or the inlet of the continuing channel portion 15 that is in line with said valve outlet.

In the exemplary embodiment shown, the detachable clamping connection 16 is implemented by a screw connection which, as shown, contains two or alternatively only one or more than two screw bolts and associated bores in the retaining flange 1*b* of the casting container 1 and at the same time forms the detachable connection 12, which holds the valve main body 8 on the casting container 1. In alternative embodiments, the detachable connection 12 on the one hand and the detachable clamping connection 16 on the other hand may be formed by two separate detachable connection units.

In the assembled state of the shut-off control valve 7, the clamping connection 16 pretensions the valve main body 8 reliably in a sealing manner against the seal 17 and at the same time holds the valve main body 8 fixedly on the casting container 1. The fixed hold of the valve main body 8 on the casting container 1 is loosened by detaching the clamping connection 16 or the detachable connection 12, with the result that the shut-off control valve 7 can be disassembled as required from the casting container 1.

In advantageous embodiments, the shut-off control valve 7, as in the example shown, has a control rod 18, which is guided in a translatory-movable manner on the valve main body 8, at one end bears the valve closing body 10 and with its other end extends out of the valve main body 8, and extends out of the casting container 1 through a rod passage opening 19 in the casting container 1.

In the casting container position according to FIGS. 1, 3 and 4, the valve closing body 10 is located at the bottom end of the control rod 18. At the top end, which is not of further interest here and therefore is not shown, the control rod 18 has a suitable actuation interface, by way of which it can be made to perform the desired translatory valve actuation movement parallel to its longitudinal axis, as desired and depending on the usage situation, manually by a user or automatically by means of a control unit. FIGS. 1 and 3 show the control rod 18 in its closed position, in which the valve closing body 10 in its closed position lies against the valve seat 9 in a fluid-tight manner and shuts off the melt inlet channel 5. FIG. 4 shows the control rod 18 in its open position, in which the valve closing body 10 is located in its open position which is raised or remote from the valve seat 9 and, as a result, opens up the melt inlet channel 5 for the throughflow of melt material.

In corresponding embodiments, the control rod 18, as in the example shown, is arranged with its rod longitudinal axis parallel to a longitudinal axis 20 of the casting piston 3. This allows a control actuation of the control rod 18 at that side of the casting container 1 on which the control actuation of the casting piston 3 preferably also takes place or on which a corresponding control unit or actuating unit is arranged. This may be favourable e.g. in terms of a compact structure of the casting unit and/or in terms of the actuation of the casting piston 3 and the shut-off control valve 7.

In advantageous embodiments, as in the example shown, the casting unit comprises a lateral control rod insertion slot 21 in the casting container 1 for the lateral insertion of the control rod 18 into the valve receiving space 13 of the casting container 1 and for lateral removal from the same. As a result, the control rod 18 may be introduced into the casting container 1 during the assembly of the shut-off control valve 7 on the casting container 1 via the control rod insertion slot 21, the control rod insertion slot 21 leading to the rod passage opening 19. The control rod 18 thus does not need to be inserted axially into the rod passage opening 19, and it also does not need to be attached to the casting container 1 or to the valve main body 8 subsequently after the assembly of the valve main body 8, but rather can be assembled on the casting container 1 together with the valve main body 8 in a manner preassembled on said valve main body. In the same way, when the intention is to take the shut-off control valve 7 off of the casting container 1, the control rod 18 can be guided out of the casting container 1 via the control rod insertion slot 21 and, as a result, may remain on the valve main body 8 during this disassembly and also does not have to be taken out axially via the rod passage opening 19 of the casting container 1.

In advantageous embodiments, as in the example shown, the melt inlet channel 5 contains at least one transverse bore 22 in the valve main body 8 that forms the melt bath connection opening 4 on the inlet side and opens out into a longitudinal bore 23, through which the control rod 18 extends and which forms the valve seat 9 on the outlet side, in the valve main body 8 on the outlet side. In the example shown, a plurality of transverse bores 22 are provided spaced angularly equidistantly apart from one another, e.g. two transverse bores which are situated diametrally 180° opposite one another or four transverse bores offset by respectively 90° in a cross shape, the radially outer openings of the transverse bores 22 together forming the melt bath connection opening 4. In the example shown, in the operating position of the casting container 1, the at least one transverse bore 22 runs horizontally; in alternative implementations, it runs inclined to the vertical. In the example shown, in the operating position of the casting container 1, the longitudinal bore 23 runs vertically; in alternative embodiments, it runs inclined to the vertical. In the example shown, the at least one transverse bore 22 and the longitudinal bore 23 together with the valve seat 9 are formed in the base body 8*a* of the valve main body 8.

Figure 2:
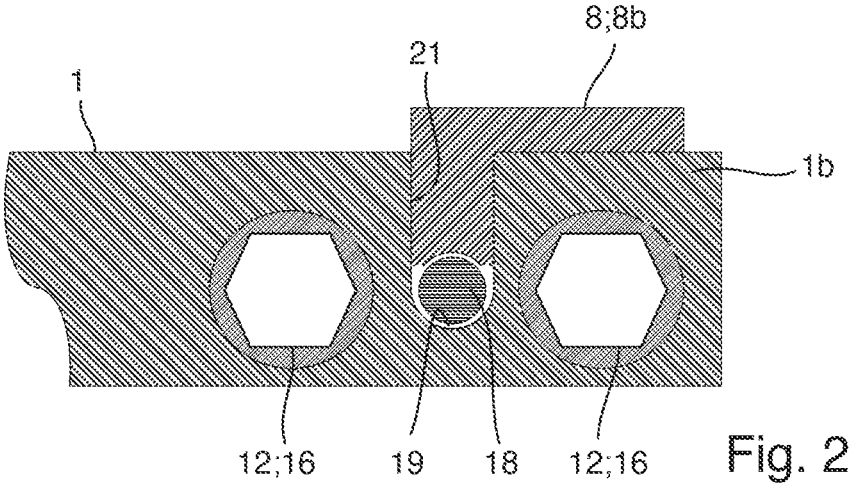
FIG. 2 shows a partial detailed view from above of the casting unit along an arrow II in FIG. 1.

Specifically, in the example shown, the control rod insertion slot 21 is located in the retaining flange 1*b* of the casting container 1, the control rod insertion slot 21 extending from that access side from which the shut-off control valve 7 or its valve main body 8 is assembled on the casting container 1, i.e. from a rearwards side in FIG. 1 and from an upper side in FIG. 2, to the rod passage opening 19. Expressed differently, in this exemplary embodiment, a closed slot end region of the control rod insertion slot 21 forms the rod passage opening 19 of the casting container 1.

FIGS. 3 and 4 illustrate the casting unit in its operationally ready state for use in a corresponding die casting machine. For this purpose, the casting container 1 is dipped in a manner which is customary per se into a melt bath 24, which is stored in a melt container 25. In this respect, the casting container 1 is dipped into the melt bath 24 at least deep enough that the melt bath connection opening 4 of the shut-off control valve 7 assembled on the casting container 1 lies below an associated melt bath level 24*a*. In a likewise customary manner, the melt outlet channel 6 forms a riser channel 6*a*, which opens out of the casting container 1 with a mouth nozzle piece 6*b*, on which is pushed a mouth nozzle body 26 with an associated end-side connection region 26*a*. In a likewise customary manner which is not of further interest here, the mouth nozzle body 26 leads with an outlet-side end region 26*b* to a sprue mouth opening or gate opening of a casting mould of the die casting machine.

During operation, to carry out a respective casting operation, the casting piston 3 in the casting chamber 2 may be moved forwards out of a start position, i.e. downwards in FIGS. 3 and 4, in order to press melt material out of the casting chamber 2 via the melt outlet channel 6 and the nozzle body 26 into the casting mould, the shut-off control valve 7 being located in its closed position, shown in FIG. 3. Merely for illustration purposes, in FIGS. 3 and 4 the melt material is shown as prevailing as far as the outlet-side end region 26*b* of the nozzle body 26. After the melt material has solidified in the casting mould, which casting mould is not illustrated, to form a corresponding cast part, the casting piston 3 in the casting chamber 2 is moved back again to its start position, i.e. upwards in FIGS. 3 and 4. In the process, the shut-off control valve 7 is brought into its open position, illustrated in FIG. 4, with the result that melt material passes out of the melt bath 24 via the melt inlet channel 5 into the casting chamber 2. Subsequently, after the shut-off control valve 7 is closed, a new casting operation can be carried out.

As is made clear by the exemplary embodiments shown and the further exemplary embodiments mentioned above, the invention in a very advantageous manner provides a casting unit for a die casting machine, in which the shut-off control valve for the melt inlet channel is attached comparatively simply and flexibly to the casting container in such a way that it is readily accessible, the shut-off control valve being held on the casting container preferably in a detachable manner.

What is claimed is:

1. A casting unit for a die casting machine, comprising:
a casting container with a casting chamber;
a casting piston, which is arranged in an axially movably manner in the casting chamber;
a melt bath connection opening;
a melt inlet channel from the melt bath connection opening to the casting chamber;
a melt outlet channel, which leads out of the casting chamber separately from the melt inlet channel; and
a shut-off control valve for the melt inlet channel, the shut-off control valve comprising a valve main body, which is arranged on the casting container and has a valve seat, and a valve closing body which is movable relative to the valve seat between an open position and a closed position,
wherein
the valve main body is held on the casting container at a lateral valve assembly region of the casting container in a manner accessible from outside and comprises the melt bath connection opening.

2. The casting unit according to claim 1, wherein
the casting piston is of a spool type, and
the shut-off control valve is located with its valve closing body in the melt inlet channel at a flow-technical distance behind the melt bath connection opening on the one hand and in front of the casting chamber on the other hand.

3. The casting unit according to claim 1, wherein
the valve main body of the shut-off control valve is held on the casting container by a detachable connection.

4. The casting unit according to claim 1, wherein
the valve assembly region of the casting container is formed by a valve receiving space with a laterally outwardly facing access side, and
the valve main body of the shut-off control valve is inserted into the valve receiving space laterally from the outside via the access side.

5. The casting unit according to claim 4, wherein
the valve main body is inserted into the valve receiving space with a downwardly pointing valve outlet, and
the melt inlet channel continues from the valve outlet with a channel portion in the casting container which leads downwardly out of the valve receiving space.

6. The casting unit according to claim 5, wherein
the valve main body is held in a clamped-in manner in a vertical direction in the valve receiving space by a detachable clamping connection and on an underside bears against a seal which seals the valve outlet.

7. The casting unit according to claim 1, wherein
the shut-off control valve has a control rod, which is guided in a translatory-movable manner on the valve main body, at one end bears the valve closing body and with its other end extends out of the valve main body and out of the casting container through a rod passage opening in the casting container.

8. The casting unit according to claim 7, wherein
the control rod is arranged with its rod longitudinal axis parallel to a longitudinal axis of the casting piston.

9. The casting unit according to claim 7, further comprising:
a lateral control rod insertion slot in the casting container for lateral insertion of the control rod into the valve receiving space of the casting container and for lateral removal from the same.

10. The casting unit according to claim 1, wherein
the melt inlet channel contains at least one transverse bore in the valve main body that forms the melt bath connection opening on an inlet side and opens out into a longitudinal bore in the valve main body on an outlet side, through which bore the control rod extends and which bore forms the valve seat on the outlet side.

11. A casting unit for a die casting machine, comprising:
a casting container with a casting chamber;
a casting piston, which is arranged in an axially movably manner in the casting chamber;
a melt bath connection opening;
a melt inlet channel from the melt bath connection opening to the casting chamber;
a melt outlet channel, which leads out of the casting chamber separately from the melt inlet channel; and
a shut-off control valve for the melt inlet channel, the shut-off control valve comprising a valve main body, which is arranged on the casting container and has a valve seat, and a valve closing body which is movable relative to the valve seat between an open position and a closed position, wherein the casting piston is of a spool type, and the shut-off control valve is located with its valve closing body in the melt inlet channel at a flow-technical distance behind the melt bath connection opening on the one hand and in front of the casting chamber on the other hand.

12. The casting unit according to claim 11, wherein the valve main body of the shut-off control valve is held on the casting container by a detachable connection.

13. The casting unit according to claim 11, wherein the valve assembly region of the casting container is formed by a valve receiving space with a laterally outwardly facing access side, and the valve main body of the shut-off control valve is inserted into the valve receiving space laterally from outside via the access side.

14. The casting unit according to claim 13, wherein the valve main body is inserted into the valve receiving space with a downwardly pointing valve outlet, and the melt inlet channel continues from the valve outlet with a channel portion in the casting container which leads downwardly out of the valve receiving space.

15. The casting unit according to claim 14, wherein the valve main body is held in a clamped-in manner in a vertical direction in the valve receiving space by a detachable clamping connection and on an underside bears against a seal which seals the valve outlet.

16. The casting unit according to claim 11, wherein the shut-off control valve has a control rod, which is guided in a translatory-movable manner on the valve main body, at one end bears the valve closing body and with its other end extends out of the valve main body and out of the casting container through a rod passage opening in the casting container.

17. The casting unit according to claim 16, wherein the control rod is arranged with its rod longitudinal axis parallel to a longitudinal axis of the casting piston.

18. The casting unit according to claim 16, further comprising:

a lateral control rod insertion slot in the casting container for lateral insertion of the control rod into the valve receiving space of the casting container and for lateral removal from the same.

19. The casting unit according to claim 11, wherein the melt inlet channel contains at least one transverse bore in the valve main body that forms the melt bath connection opening on an inlet side and opens out into a longitudinal bore in the valve main body on an outlet side, through which bore the control rod extends and which bore forms the valve seat on the outlet side.

* * * * *